US005467547A

United States Patent [19]

Fortner

[11] Patent Number: 5,467,547

[45] Date of Patent: Nov. 21, 1995

[54] SELF-ERECTING DISPLAY STAND THAT AUTOMATICALLY DIMENSIONALIZES FRONT PANELS

[75] Inventor: Larry L. Fortner, Huntington Beach, Calif.

[73] Assignee: Graphic Communications, Inc., Golden, Colo.

[21] Appl. No.: 150,391

[22] Filed: Nov. 10, 1993

[51] Int. Cl.[6] ..... G09F 15/00

[52] U.S. Cl. ..... 40/610; 40/124.1; 40/539

[58] Field of Search ..... 40/120, 124.1, 40/155, 539, 610, 606; 248/174, 459

[56] References Cited

U.S. PATENT DOCUMENTS

| | | | |
|---|---|---|---|
| 2,601,374 | 6/1952 | Ditzler et al. . | |
| 3,017,148 | 1/1962 | Wathen | 248/459 |
| 3,091,877 | 6/1963 | Luchsinger . | |
| 3,267,597 | 8/1966 | Jannes . | |
| 3,664,049 | 5/1972 | Smith . | |
| 3,721,029 | 3/1973 | Austin . | |
| 3,727,874 | 4/1973 | Wuensch | 248/174 X |
| 3,775,884 | 12/1973 | Smith . | |
| 4,235,032 | 11/1980 | Robinson | 40/539 |
| 4,570,805 | 2/1986 | Smith . | |
| 4,619,426 | 10/1986 | Drueck, Jr. . | |
| 4,773,622 | 9/1988 | Herlin . | |
| 4,854,060 | 8/1989 | Corbo et al. . | |

FOREIGN PATENT DOCUMENTS

| | | | |
|---|---|---|---|
| 2650907 | 2/1991 | France | 40/606 |
| 2311263 | 9/1973 | Germany | 40/539 |
| 350798 | 6/1931 | United Kingdom | 40/539 |

*Primary Examiner*—Brian K. Green
*Attorney, Agent, or Firm*—Sheridan, Ross & McIntosh

[57] ABSTRACT

A collapsible, self-erecting display stand has a back panel, a front display panel, a side support panel, and a biasing member. From its collapsed configuration, the biasing member urges the back panel and side support panel to a position supporting a free-standing display stand and, simultaneously, the front display panel is projected outwardly to achieve a three-dimensional effect.

33 Claims, 13 Drawing Sheets

SELF-ERECTING DISPLAY STAND THAT AUTOMATICALLY DIMENSIONALIZES FRONT PANELS

FIELD OF THE INVENTION

The present invention relates to a collapsible, self-erecting display stand that automatically dimensionalizes front panels. In particular, the present invention relates to a display device in which support legs are automatically positioned while a front display panel is simultaneously projected outwardly in a forward direction.

BACKGROUND OF THE INVENTION

Collapsible, self-erecting, hollow, foldable devices utilizing internal elastic or biasing bands are described in U.S. Pat. Nos. 4,619,426, 3,267,597, 4,773,622, and 3,664,049. In such devices, the elastic bands usually stretch between two endwalls, which are hingedly connected to the remaining sidewalls. In this regard, when the flattened device is released from its collapsed, folded position, the elastic bands typically urge the endwalls toward one another, thus erecting such hollow devices.

Elastic bands have also been used to erect foldable merchandise display stands, as exemplified by U.S. Pat. No. 4,570,805. In this device, an elastic member urges the connecting portions toward one another and thus the side panel portions toward the common planes of the side panels to erect the merchandise display stand with a snap action. As the elastic member acts, a shelf connected to a front panel is pulled through a slit, thus providing a horizontal shelf surface upon which goods or merchandise may be displayed.

In designing stands that display pictures, images, photographs or posters for use in movie theaters and retail stores, the following must be considered: the display must capture the attention of consumers; it must be attractive; the display should be easy to handle, erect and store; and the display should be relatively inexpensive.

Accordingly, it would be advantageous to provide a display stand that satisfies the design considerations delineated above. It would also be advantageous to provide a new and improved self-erecting display stand that automatically dimensionalizes display panels. It would also be advantageous to provide a self-erecting display stand that collapses and folds such that it may be easily stored and shipped in compact containers, and, upon removal from such container, the display stand may be unfolded and self-erect. It would also be advantageous to provide an attractive, eye-catching self-erecting display stand that is inexpensive to manufacture and simple to erect.

SUMMARY OF THE INVENTION

In accordance with the present invention, a display stand is provided that accomplishes two tasks substantially simultaneously. First, the display stand self-erects from a collapsed configuration to a standing position. Second, as the display stand self-erects, a front display panel projects as it moves upwardly and outwardly, producing a pseudo three-dimensional effect.

In one embodiment of the invention, the display stand may include a side support leg, a front display panel, a back panel and a biasing device. When the biasing device is released from its extended configuration, the side support legs move from a position substantially planar with the back panel to a second position which is capable of supporting a free standing display stand. Simultaneously, as the biasing device is released from its extended state, tongues on the side support legs push upon the front display panel, projecting the front display panel outwardly.

In another embodiment of the present invention, the display stand includes a side support panel, a back panel, a front display panel and a biasing device. The side support panel is flexibly connected to a longitudinal edge of the back panel. The side support panel includes a tongue and a point at which the biasing device engages. Additionally, flaps may be provided in order to flexibly fasten the back panel to the front display panel. In its collapsed configuration, the biasing device is in an extended state and the side support panel is substantially planar with the back panel. However, when released from its extended state, the biasing device urges the side support panel to a position supporting a free standing display stand. Simultaneously, the tongue of the side support panel rotates and pushes against the front display panel, projecting the front display panel upwardly and outwardly, and moving the front display panel arcuately to produce an eye-catching, pseudo three-dimensional effect.

In another embodiment of the invention, the display stand includes a front display panel, a back panel, a first side support panel, a second side support panel, and a biasing device. The first side support panel and second side support panel are flexibly fastened to a first and a second longitudinal edge of the back panel. The first and second side support panels also include tongues and points upon which the biasing device engages. Additionally, the front display panel is flexibly fastened to the back panel by flaps. As the biasing device is released from its extended state, the first and second side support panels move from a first position substantially planar to the back panel to a second position which supports a free standing display stand. Simultaneously, the tongues of the first and second side support panels rotate with the first and second side support panels, protrude through corresponding holes in the back panel and push against the front display panel, thereby projecting the front display panel upwardly and outwardly in an arcuate motion to present an attractive pseudo three-dimensional effect.

DETAILED DESCRIPTION OF THE INVENTION

The present invention accomplishes two tasks substantially simultaneously. First, the display stand automatically self-erects from a collapsed configuration and second, as the display stand self-erects, a display panel projects, producing a pseudo three-dimensional effect. To accomplish these two tasks, the preferred embodiment features a biasing device and a tongue that pushes upon and projects a display panel as the biasing device contracts. In this regard, the present invention provides a large, upright display stand that catches a consumer's attention and effectively communicates a message or image to the viewer.

Generally, the display device includes a number of panels and a biasing device. In order to provide a durable, dependable, yet inexpensive display stand, the panels of the display apparatus can be fabricated from any suitable rigid material such as cardboard, paperboard, plastic, wood, fabric and metal. Additionally, the biasing device can be selected from a group including of rubber bands, elastic bands and springs.

The display apparatus generally includes three types of panels: a front panel, a back panel and a support panel. The primary purpose of the front panel is to be capable of projecting outward in a forward direction. In this way the front panel can be capable of attracting the attention of the public and effectively communicate information or images to the public. The front panels can be attached to the back panel. In this regard, the back panel acts as a load-bearing panel by supporting the front panels. A support panel must also be included in order to support and stabilize the back and front panels when the display apparatus is in an upright configuration. In a preferred embodiment, the support panel is attached to a longitudinal edge of the back panel. Additionally, the display apparatus can include an intermediate panel in order to further support and stabilize the display apparatus and to display more information and images. Such an intermediate panel can be positioned in between the front display panels and the back panel.

Figure 2:
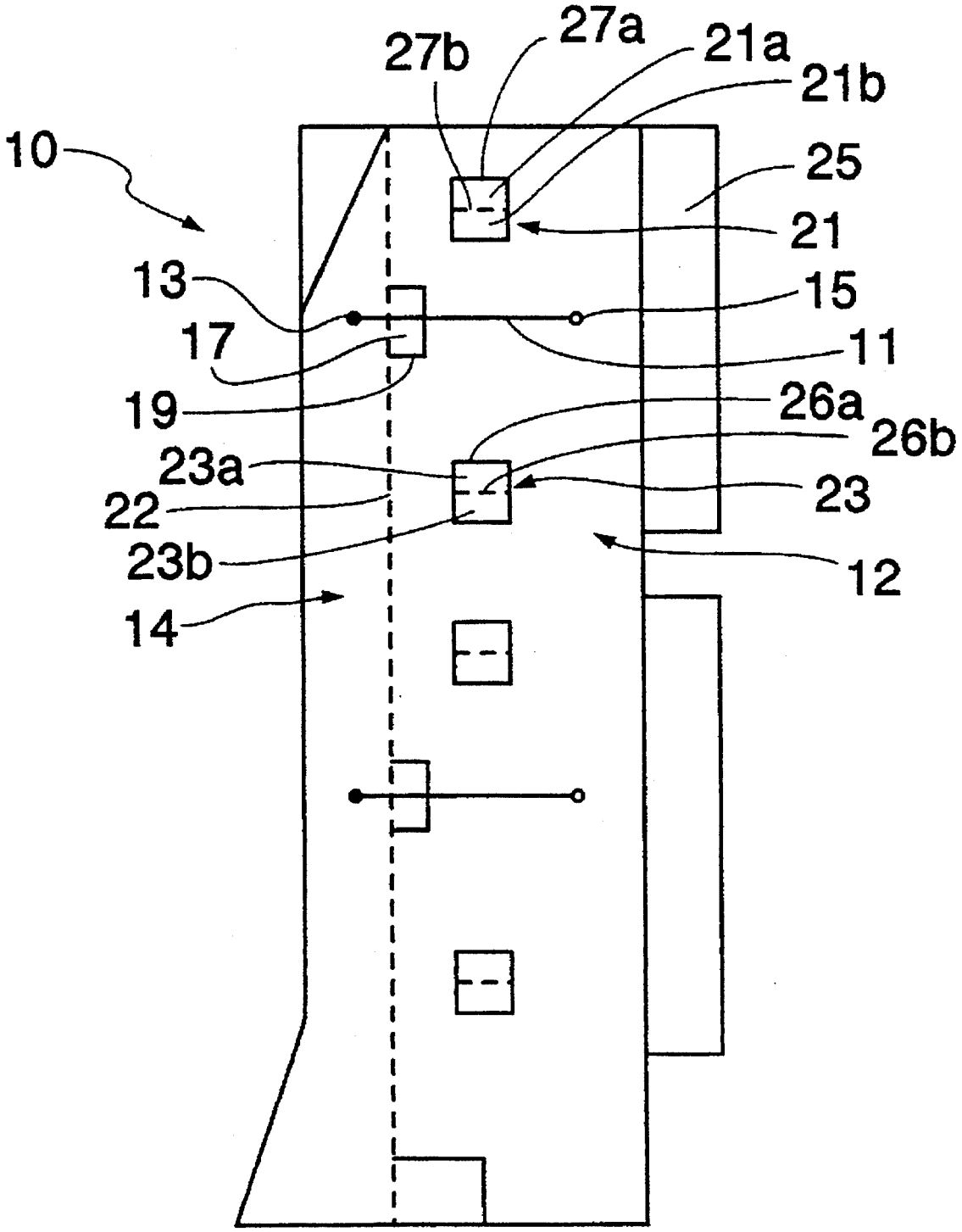
FIG. 2 is a rear view of the display stand of FIG. 1 in its collapsed configuration.

Preferably, the panels of the display apparatus are fabricated from such materials as cardboard and paperboard. In this regard, the panels may be die-cut quickly and efficiently. Although such panels, tongues and flaps can be die-cut, other ways of forming these members are possible, such as knife-cutting, laser cutting and forming the material to the appropriate shape and size at the outset. Although the following description refers to die-cutting, it will be expressly understood that other means of obtaining the proper shape can also be employed. Preferably, the back panel and support panel are die-cut from a single piece of material such that the back and support panels are flexibly connected together and are not provided separately. As shown in FIG. 2, in one embodiment of the present invention, the side support panel 14 is flexibly connected with the back panel 12 along a longitudinally oriented fold line 22. Alternatively, the support panel and the back panel may be provided separately. In such an embodiment where the side support panel and the back panel are provided separately, the support panel may be flexibly connected to a longitudinal edge of the back panel in order to provide support to the display apparatus. In this regard, hinge-type devices, tape, or VELCRO™, can be used to flexibly connect and/or reinforce the flexible connection between the side support panel and the back panel.

In die-cutting the side support panel and the back panel, a tongue and corresponding hole are formed. The tongue 17, illustrated in FIG. 2 of display apparatus 10, is generally rectangular in shape and is integrally connected to the side support panel 14 at the fold line 22 that connects the side support panel 14 to the back panel 12. The remaining three sides of the tongue lie within the back panel when the display apparatus is in a collapsed configuration, shown in FIG. 2.

The front display panel is preferably die-cut from cardboard or paperboard. The front display panels may be die-cut according to the various shapes, configurations, and/or sizes desired. This is especially advantageous in providing an attractive and appealing display device as the shape and size of the front display panel can effectively communicate or complement the message or image displayed upon the front display panel. In this regard, the front display panel can display a written message, photographs, images or pictures.

To provide a front display panel that presents a pseudo three-dimensional effect, flaps can be provided. As shown in FIG. 2, the flaps 21 and 23 can be die-cut and integrally and flexibly connected to the back panel along the fold lines 27 and 29. Alternatively, the flaps can be separate pieces which are attached and extend between the front display panel and the back panel. Such separate flaps 47 and 48 are illustrated in another embodiment in FIG. 5. The size of the flap is generally dependent upon the amount of projection of the front display panel desired. In a preferred embodiment, the amount of projection allowed by the flaps correspond with the maximum protrusion of the tongues from the back panel.

Figure 11:
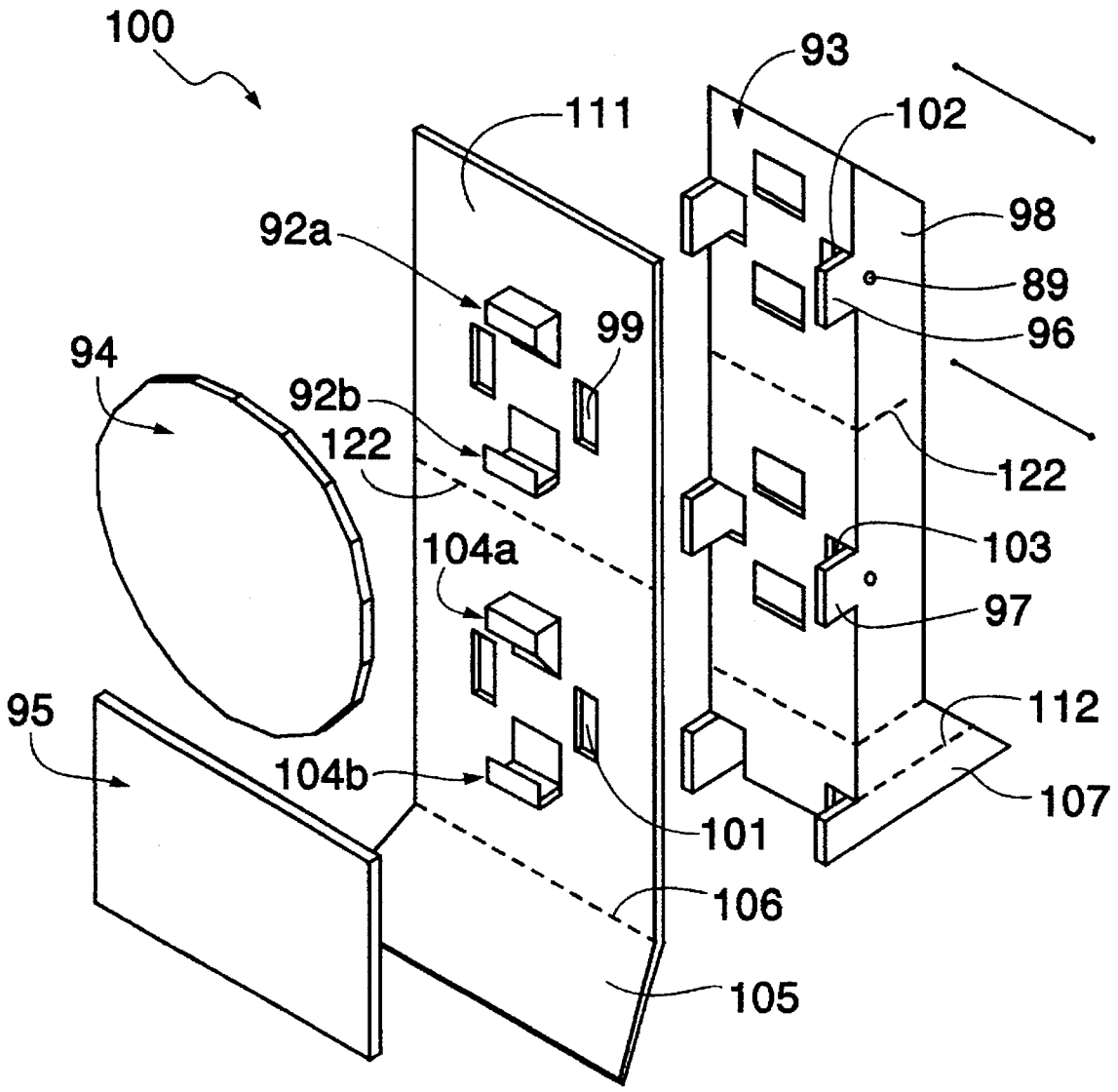
FIG. 11 is an exploded view of the display stand of FIG. 10.

In one embodiment of the invention, shown in FIG. 11, an intermediate panel 111 may be positioned between the front display panels 94 and 95 and the back panel 93. The intermediate panel may be attached to the back panel by an adhesive such as glue or tape. In a preferred embodiment, the front display panels are attached to the intermediate panel by die-cut flaps **92*a*, 92*b*, 104*a* and 104*b*** that are integrally and flexibly connected with the intermediate panel along a fold line. Alternatively, these die-cut flaps can be separate die-cut pieces.

A biasing device should also be provided in order to self-erect the display stand and to project the front display panels. Generally, the biasing device extends between two panels and is connected to the panels at engagement points. For example, the engagement point can be a hole, slit, or slot. Alternatively, the biasing means can be attached to the panels by a mechanical device such as a staple, hook, nail, tack, or with an adhesive such as tape or glue.

The display apparatus may be collapsed in order to facilitate storage, shipping and handling. In one embodiment of a collapsed configuration of the display apparatus, shown in FIG. 6, the biasing device 31 extends between two side support panels 32 and 34. Preferably, the biasing device 31 is extended to a stretched position such that the support panels and the back panels are substantially planar. Alternatively, in a collapsed configuration of the display apparatus, the biasing device can be a compressed spring.

Figure 13:
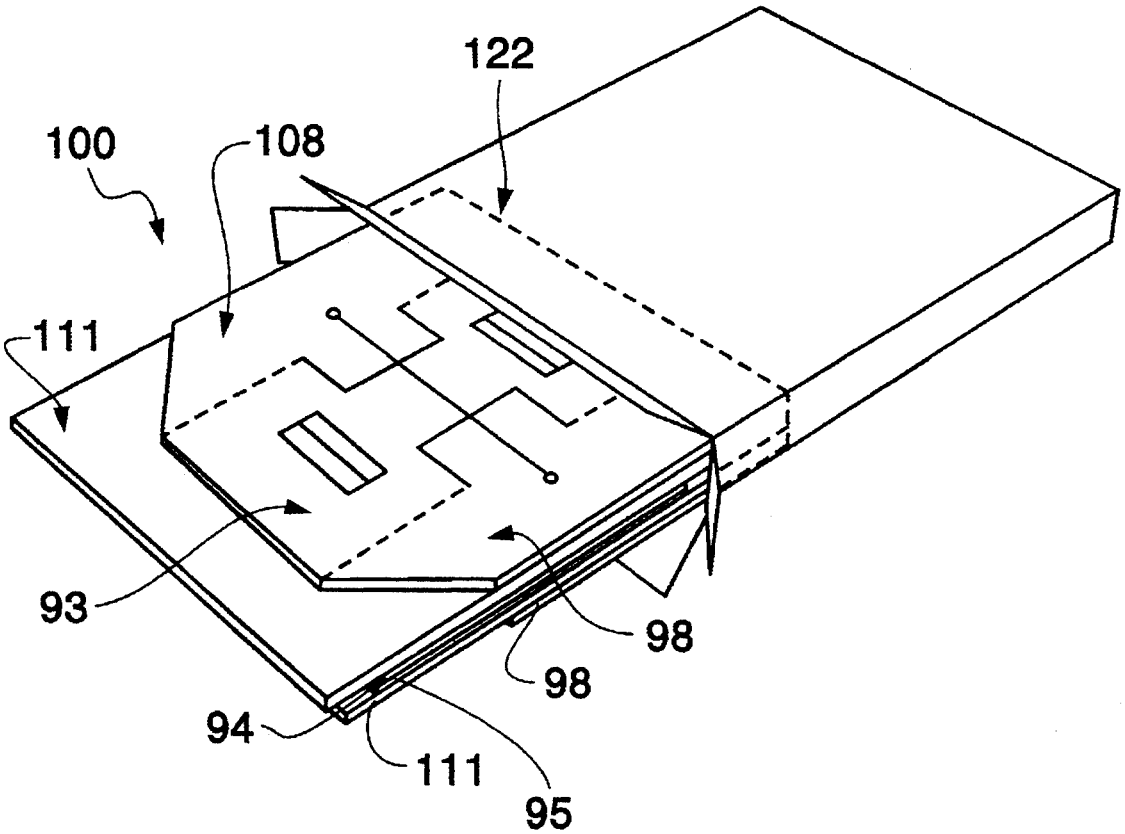
FIG. 13 is a perspective view of the display stand of FIG. 10 in its collapsed and folded configuration as it is removed from a storage and shipping carton.

Once collapsed, one embodiment of the display apparatus may be folded, as shown in FIG. 13. Folding the display apparatus not only facilitates shipping and handling but also provides for a light-weight and compact display apparatus. In order to provide for a foldable display apparatus, a fold line should be provided. Preferably, such a fold line can be provided to the back and side support panels along a laterally oriented line such that the collapsed display apparatus can be folded, for example, into halves or thirds. When the display apparatus is in its collapsed and folded configuration, as shown in FIG. 13, the display apparatus may be placed in a shipping container for storage or delivery. Such a container also prevents the folded and collapsed display apparatus from unfolding and erecting unexpectedly.

Upon receiving a collapsed and folded display apparatus, the purchaser can either store the boxed display apparatus or set the display stand up immediately. Setting up the display apparatus is particularly fast and convenient, requiring minimal skill and training. First, the folded and collapsed display apparatus is taken out of the box or shipping container. Second, the folded and collapsed display stand is manually unfolded to its collapsed configuration. The display stand can then be released from its collapsed position. This allows the pressures from the stretched or compressed biasing device to contract or expand, respectively, thus urging the side support panels to a position substantially supporting an upright and free-standing orientation of the display stand. As the side support panels are rotated to a support position, the die-cut tongues of the side support panels also rotate and push upon the front display panels. Thus, as the biasing device urges the side support panels to a position supporting a free-standing orientation of the display stand, simultaneously, the die-cut tongues move the front display panels in an arcuate motion, upwardly and outwardly, to provide a pseudo three-dimensional effect.

In a preferred embodiment, the free-standing configuration of the display apparatus is dependent upon the biasing device and upon the amount of front display panel projection desired. Initially, in its collapsed configuration, the side support panel and die-cut tongue is positioned substantially planar with the back panel. Alternatively, the tongues can be in a plane that is not planar with the back panel when the display apparatus is in a collapsed configuration. However, such an embodiment would not offer the compact advantages of a collapsed display apparatus in which the tongues were planar with the back panel. The biasing device is in its extended state and the die-cut flaps are in a collapsed configuration while the display apparatus is collapsed. In order to support an upright free-standing configuration of the display apparatus, the side support panels should be positioned about the back panel such that the display apparatus is stable when standing upright. In this regard, the side support panels may be rotated between 10° and 170° from its initial position. Rotating the side support panels not only provides support for a free-standing configuration of the display stand, but simultaneously lifts the front display panel upwardly and pushes the front display panel outwardly, away from the side support panels and back panel due the action of the side support panels' die-cut tongues upon the front display panel. To achieve the desired projection of the front display panel and desired position of the side support panel, the biasing device should be selected such that when contracted from an extended state, the biasing device allows the side support panel to be positioned at an appropriate angle. Additionally, the die-cut flaps should be appropriately sized such that when the die-cut tongues rotate and push upon the front display panel, the die-cut flaps extend accordingly.

More preferably, to achieve a greater amount of projection of the front display panel, the biasing device should be selected such that when contracted from an extended state, the side support panel has rotated between 45° and 135°. More preferably, the biasing device contracts from an extended state to allow the side support panel to rotate between 60° and 120°, thus producing an even greater amount of projection of the front display panel. More preferably, the biasing device is selected such that when contracted from an extended state, the side support panel has rotated from about 75° to 105°. In the preferred embodiment, the biasing device should be selected such that when contracted from an extended state, the side support panels have rotated about 90° from their initial, collapsed position. In the preferred embodiment, the side support panels are positioned substantially perpendicular to the back panel or about 90° from the initial position. This configuration can provide maximum projection of the front display panel depending upon the position and orientation of the tongues upon the front display panel and upon the die-cut flaps that can correspond, when extended, to the die-cut tongues.

Alternatively, the display apparatus can have built in stops if desired. However, by carefully selecting the appropriate biasing device and by die-cutting the side support panels' tongues appropriately, such that the die-cut tongues of the side support panels correspond to the maximum projection of the front display panel, as governed by the die-cut flaps, a simpler, more attractive, stable configuration is achieved due to the positioning of the side support panels and front display panel.

Figure 1:
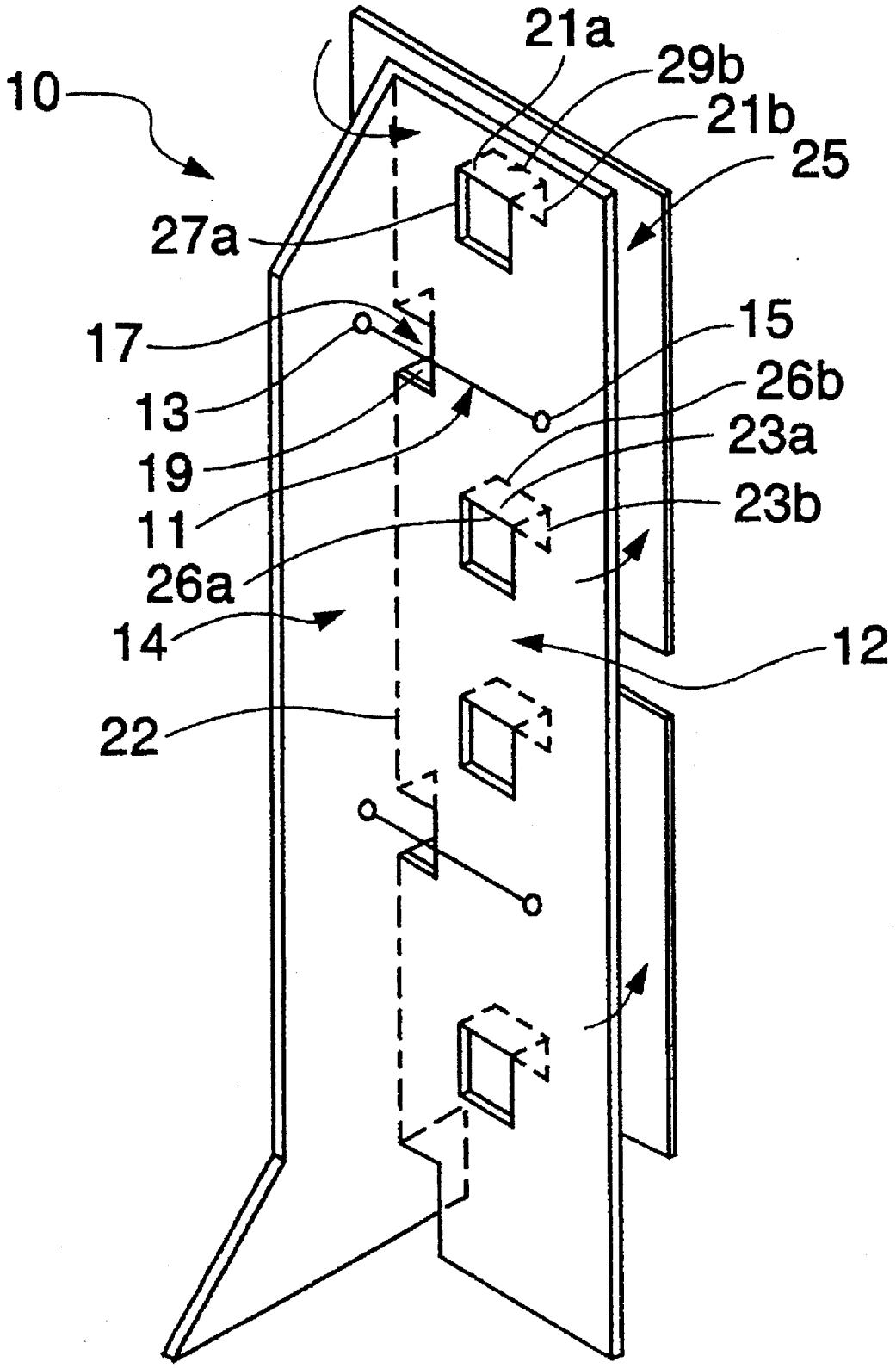
FIG. 1 is a perspective view of one embodiment of the display stand in its erect configuration.
Figure 3:
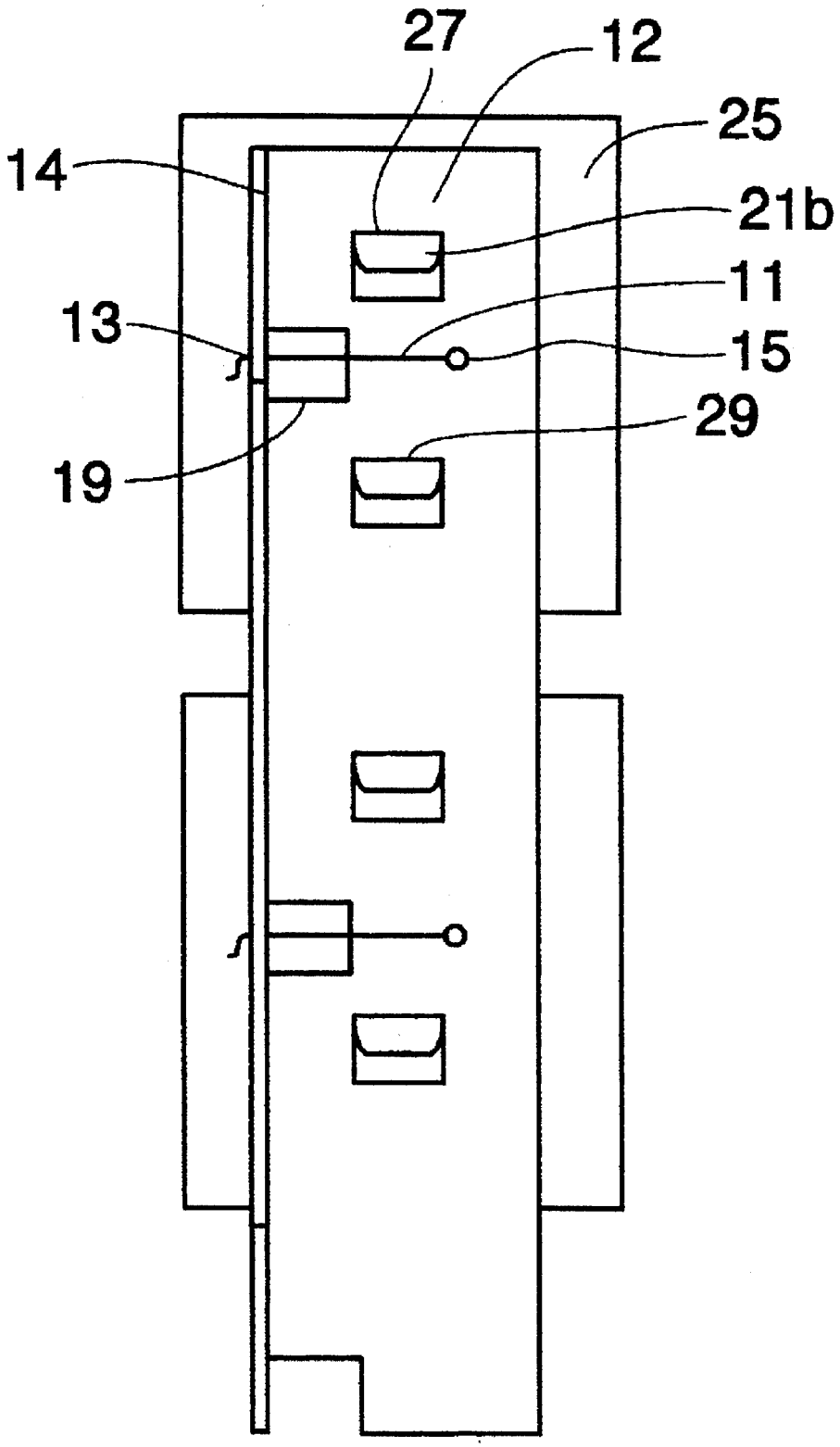
FIG. 3 is a rear view of the display stand of FIG. 1 in its erect configuration.

The present invention can be better understood by referring to the specific embodiments illustrated in the Figures. FIGS. 1, 2, and 3 illustrate an embodiment of the self-erecting merchandising display apparatus 10 that automatically dimensionalizes front display panels. The display apparatus 10 can be fabricated from any suitable rigid material, such as wood, plastic, fabric and metal, and is preferably fabricated from such materials as cardboard or paperboard.

A back panel 12 and a side support panel 14 of the display apparatus 10 is shown in a flat, collapsed configuration in FIG. 2. The back panel 12 and the side support panel 14 are flexibly fastened to each other along a longitudinal line 22. In this embodiment of the invention, the back panel 12 and the side support panel 14 are die-cut into a single panel, from which the back panel 12 and the side support panel 14 are formed and flexibly fastened together along a longitudinal fold line 22. Alternatively, the side support panel 14 and the back panel 12 can be provided separately such that the side support panel 14 is flexibly fastened to the back panel 12 by such devices as hinges or tape. If the side support panel 14 and the back panel 12 are provided separately and are not flexibly connected by and along a fold line, the side support panel 14 may be flexibly fastened to back panel 12 along a longitudinal line parallel to the fold line 22.

A rear view of the display apparatus 10, shown in FIGS. 2 and 3, shows a biasing device 11 that attaches to the side support panel 14 at an engagement point 13 with the opposing end of the biasing device 11 attached to a similar engagement point 15 on the back panel 12.

Figure 5:
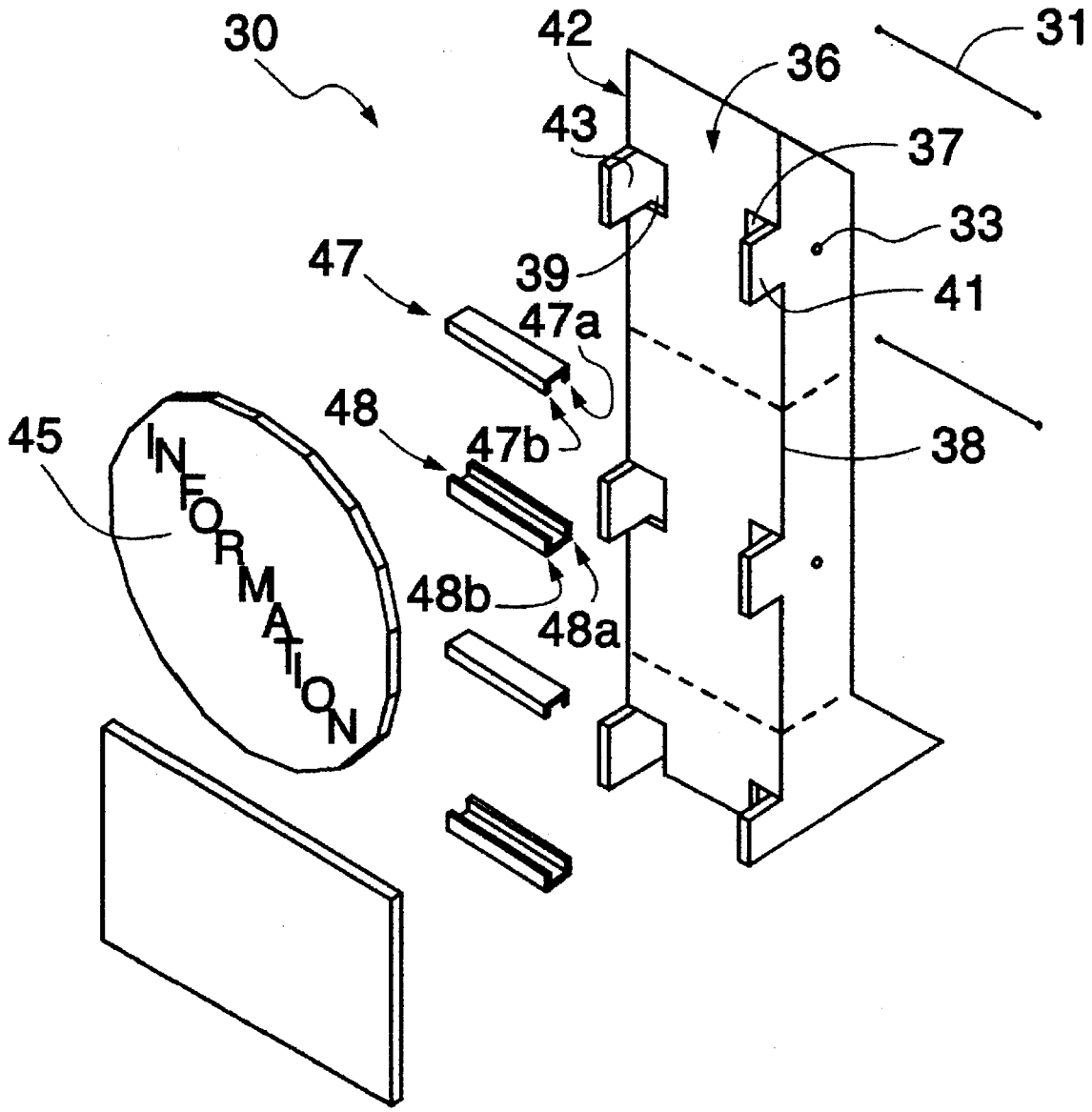
FIG. 5 is an exploded view of the display stand of FIG. 4.

As shown in FIG. 2, die-cut flaps 21 and 23 are provided on the back panel 12 to flexibly fasten a number of front display panels 25 to the back panel 12. The die-cut flaps 21 and 23 flexibly fasten the back panel 12 to the front display panels 25 so that the front display panels 25 may move in an arcuate motion upwardly and outwardly away from the back panel 12. The top portions 21*a* and 23*a* of die-cut flaps 21 and 23 are fastened to the back panel 12 along fold lines 27*a* and 26*a*, respectively, while the lower portions 21*b* and 23*b* of die-cut flaps 21 and 23 are fastened to the back side of the front display panel 25. The fold lines 27*a* and 27*b* of the die-cut flap 21 and the fold lines 26*a* and 26*b* of the die-cut flap 23 function as hinges in that they allow the front display panel 25 to rest substantially planar with the back panel 12 when the display apparatus 10 is in its collapsed position, and allows the front display panel 25 to project outwardly from the back panel 12 when the display apparatus 10 erects. The die-cut flaps 21 and 23 connecting the back panel 12 to the front display panels 25 are die-cut from the back panel 12 and are flexibly fastened to the back panel along the fold lines 27*a* and 26*a*, respectively. Alternatively, as illustrated in FIG. 5, in another embodiment, separate flaps 47 and 48 may be used whereby a first portion 47*a* of the flap 47, ending at a first fold line, may be fastened to the back panel and a second portion 47*b* of the flap 47, may be fastened to a front display panel 45.

The side support panel 14 of display apparatus 10 also includes a die-cut tongue 17, as shown in FIGS. 1, 2, and 3. The die-cut tongue 17 generally corresponds in size and shape to a die-cut hole 19, from which the die-cut tongue 17 was formed. As illustrated in FIG. 2, when the display apparatus 10 is in its collapsed configuration, the die-cut tongue 17 lies substantially within the die-cut hole 19 and is substantially planar with the back panel 12.

In the collapsed configuration of display apparatus 10, shown in FIG. 2, the biasing device 11 extends from engagement point 13 of side support panel 14 to engagement point 15, located on the back panel 12. When the display apparatus 10 is released from this collapsed position, the display apparatus 10 self-erects and, simultaneously, the die-cut tongue 17 protrudes through the die-cut hole 19 and pushes the front display panels 25 upwardly and outwardly. As the display apparatus 10 is released, the biasing device 11 urges the side support panel 14 and the back panel 12 to a position supporting a free standing display apparatus. Simultaneously, as the biasing device 11 moves the side support panel 14, the die-cut tongue 17 protrudes through the die-cut hole 19 and pushes against the front display panel 25, thereby lifting the front display panel 25 in an upward direction, and pushing the front display panel 25 outwardly, away from the back display panel 12 in a direction substantially normal to the back panel 12. The projecting front display panel 25 produces an attractive pseudo three-dimensional effect.

Figure 6:
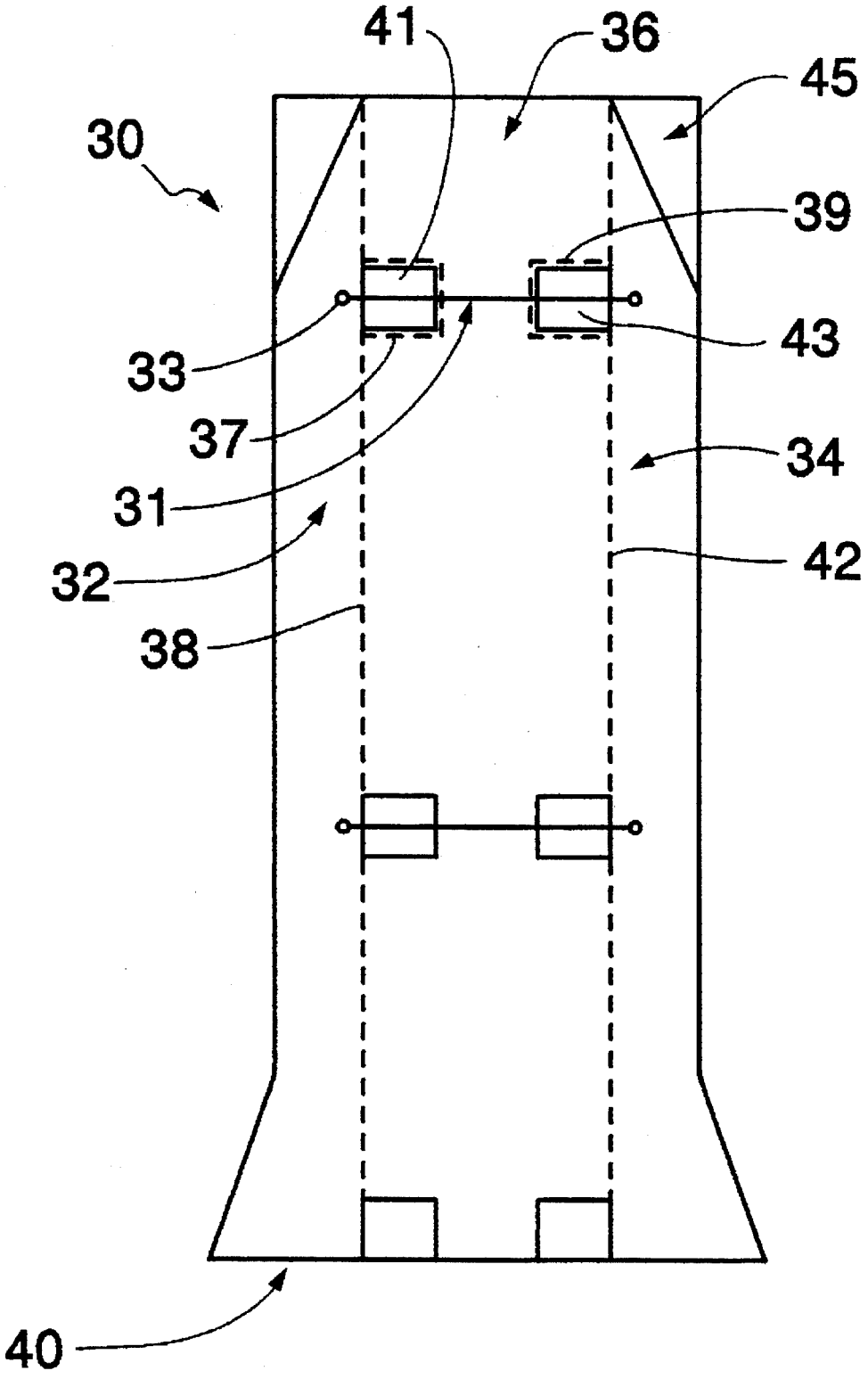
FIG. 6 is a rear view of the display stand of FIG. 4 in its collapsed configuration.

FIGS. 4–9 illustrate another embodiment of the invention. The display stand 30 has two side support panels, 32 and 34, which are flexibly connected to the back panel 36 along two parallel, longitudinally oriented lines, 38 and 42. As shown in FIG. 6, the back panel 36 and the side support panels 32 and 34 may be formed into a die-cut panel, from which the back panel 36 and the side support panels 32 and 34 are formed and flexibly fastened together along two longitudinally oriented and parallel fold lines 38 and 42. Alternatively, the first and second side support panels and back panel can be provided separately such that the side support panels are flexibly fastened to the back panel by flexible fasteners such as hinges or tape. If the side support panels and back panel are provided separately and are not flexibly connected by and at fold lines, alternatively, the side support panels may be flexibly fastened by hinges, tape or other devices, such as VELCRO™, to the back panel along longitudinal lines parallel to the fold lines 38 and 42.

Figure 4:
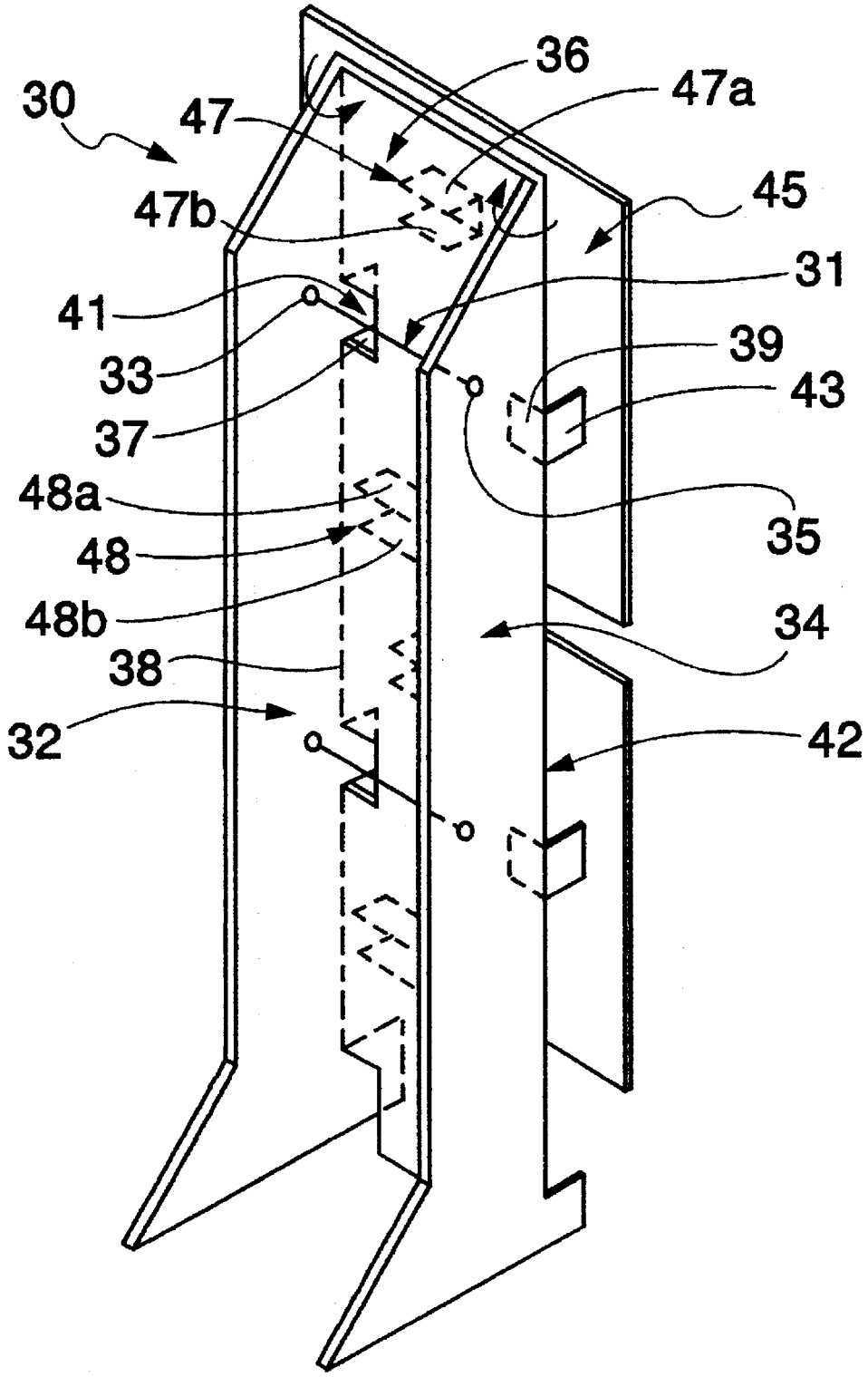
FIG. 4 is a perspective view of another embodiment of the display stand in its erect configuration.

As illustrated in FIGS. 4 and 6, the first and second side support panels 32 and 34 may be flexibly connected to a first and second edge of the back panel 36 along longitudinal fold lines 38 and 42, respectively. A biasing device 31, such as an elastic band, rubber band or spring, engages the side support panels 32 and 34 at points 33 and 35. The engagement points on the first and second side support panels, 33 and 35, secure a biasing device 31 to the first and second side support panels 32 and 34. Such engagement points may be as simple as a hole, slit, slot, hook, staple or adhesive. Each side support panel has at least one engagement point, depending upon the number of biasing devices used. Alternatively, the biasing devices can extend between the side support panels and the back panel.

Referring now to FIGS. 4 and 5, the back panel 36 may be provided with two die-cut holes 37 and 39, located along the two parallel, longitudinally oriented fold lines 38 and 42, respectively, between the back panel 36 and the side support panels 32 and 34. The die-cut holes 37 and 39 in the back panel 36 generally correspond in size and shape to the die-cut tongues 41 and 43 of the side support panels 32 and 34, respectively. A collapsed rear view of display apparatus 30, illustrated in FIG. 6, shows the die-cut tongues 41 and 43 lying substantially within the die-cut holes 37 and 39 and lying substantially planar with the back panel 36.

Figure 7:
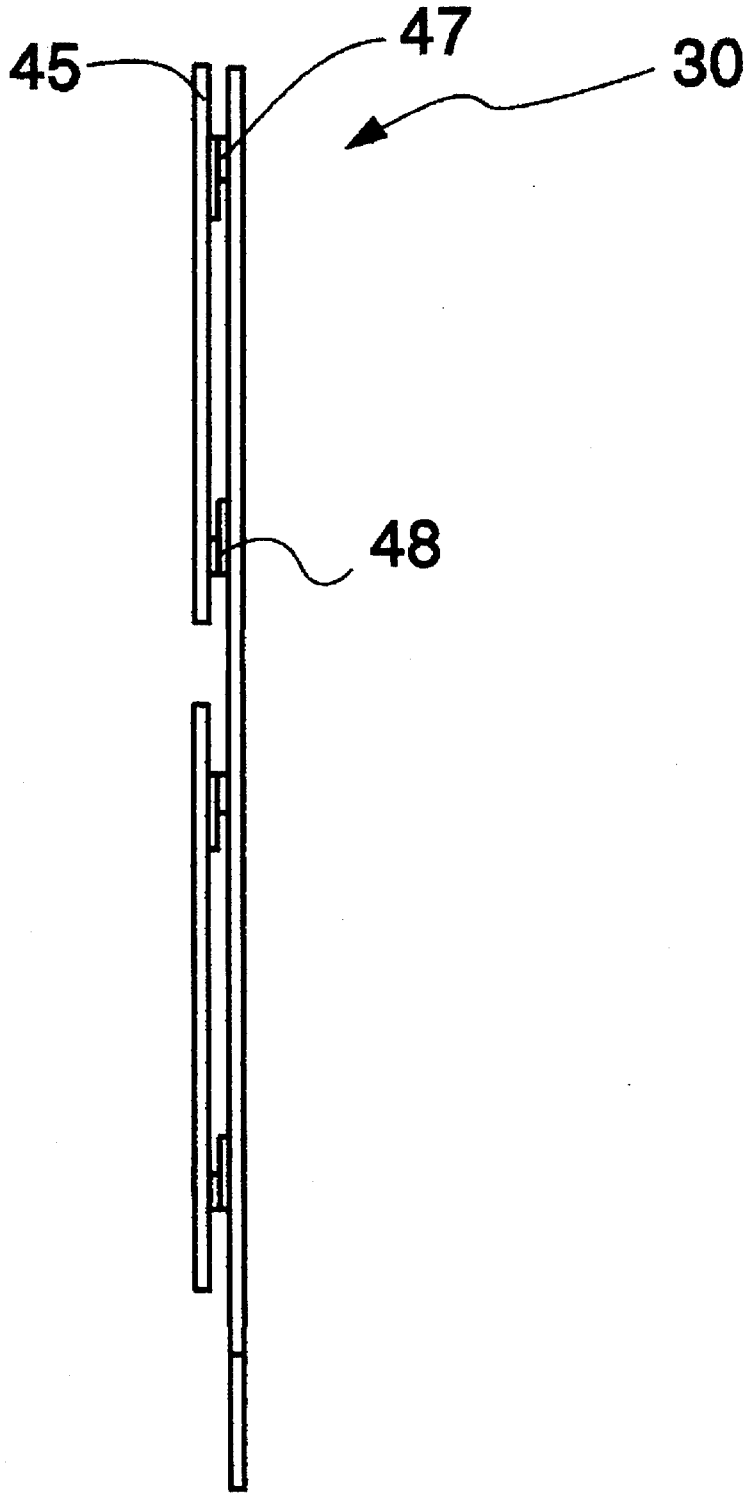
FIG. 7 is a side view of the display stand of FIG. 4 in its collapsed configuration.

A side view of the display apparatus 30 of FIG. 4 in its collapsed position is shown in FIG. 7. FIG. 6 illustrates a rear view of display apparatus 30 in its collapsed position. When the display apparatus 30 is in its collapsed position, a biasing device 31 is stretched or extended. When the display apparatus 30 is released from its collapsed position, the biasing device 31 urges the side support panels 32 and 34 to positions which support a free-standing display apparatus.

Figure 9:
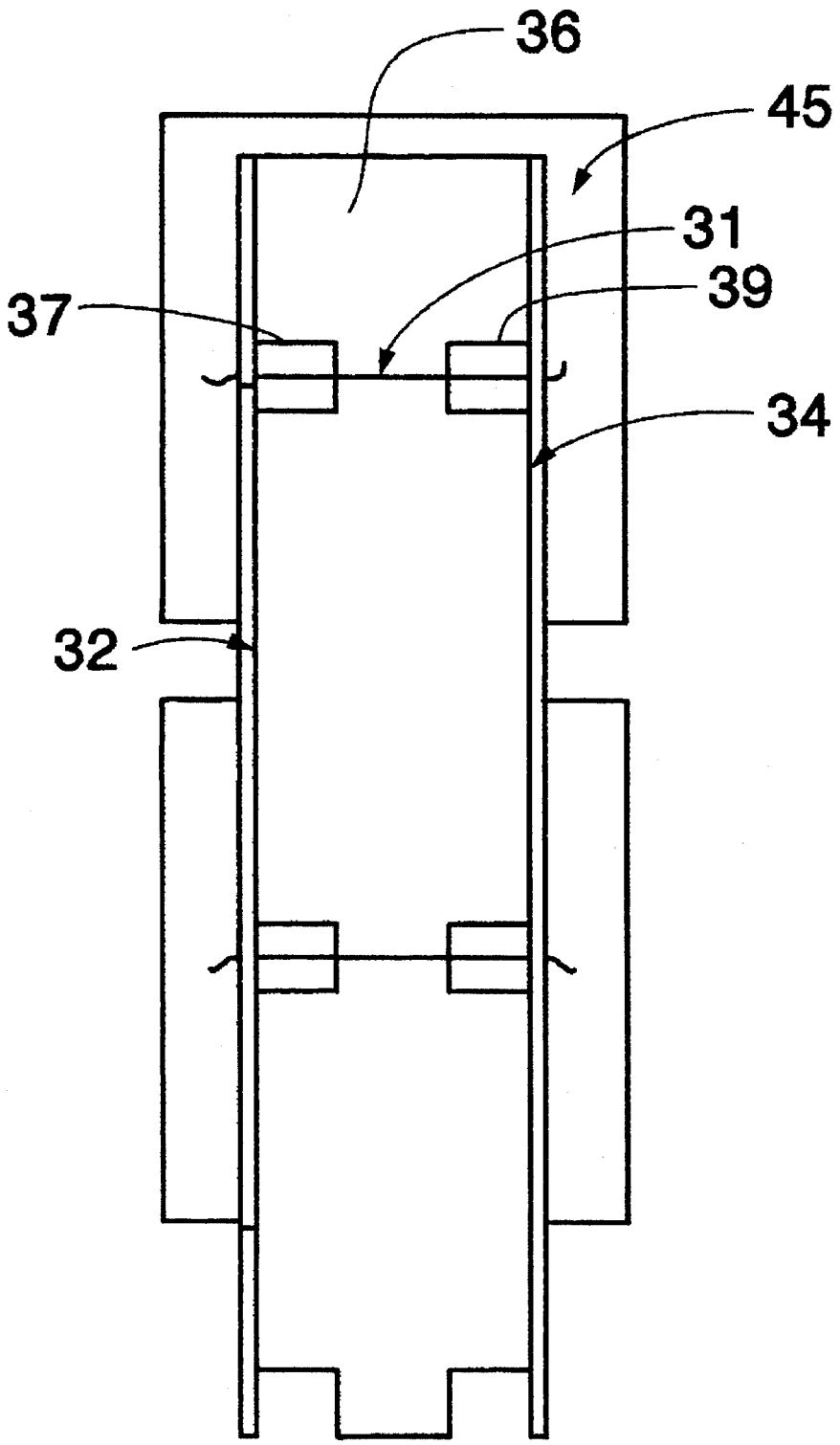
FIG. 9 is a rear view of the display stand of FIG. 4 in its erect condition.

A preferred embodiment, as shown in FIGS. 4 and 9, illustrates the free-standing configuration of the display apparatus 30. In this embodiment, the side support panels 32 and 34 are positioned substantially perpendicular to the back panel 36. This configuration provides the maximum projection of the front display panel 45 due to the position and orientation of the die-cut tongues 41 and 43 and to the corresponding extension of die-cut flaps 47 and 48. In order to provide for such a configuration, the biasing device 31 should be selected such that when contracted from an extended state, the biasing device 31 allows the side support panels 32 and 34 to lie in a plane substantially perpendicular to the back panel 36.

Figure 8:
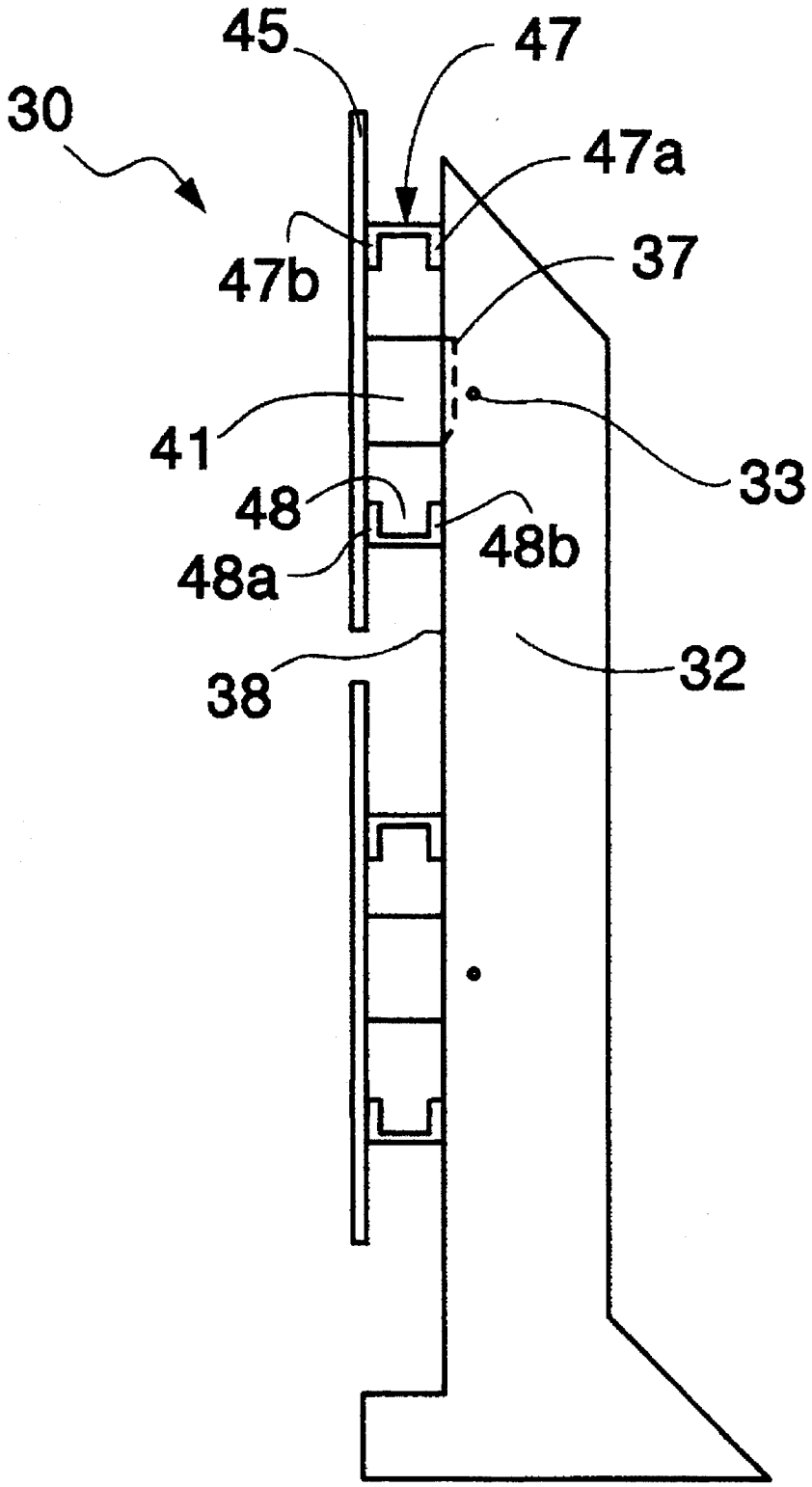
FIG. 8 is a side view of the display stand of FIG. 4 in its erect configuration.

In this preferred embodiment, as the display apparatus 30 is released from its collapsed position, the biasing device 31 urges the side support panels 32 and 34 toward each other, to a position supporting a free-standing orientation of the display apparatus 30, and simultaneously, the die-cut tongues 41 and 43 protrude through the die-cut holes 37 and 39, respectively, and push upon the back side of a front display panel 45, thereby projecting the front display panel 45 by lifting the front display panel 45 in a direction substantially upward, and pushing the front display panel outward in a direction substantially normal to the back panel 36, to achieve a pseudo three-dimensional effect, as illustrated in FIGS. 4 and 8. This pseudo three-dimensional effect provides an attractive and appealing display apparatus 30 which effectively communicates a message or image to the viewer.

Figure 12:
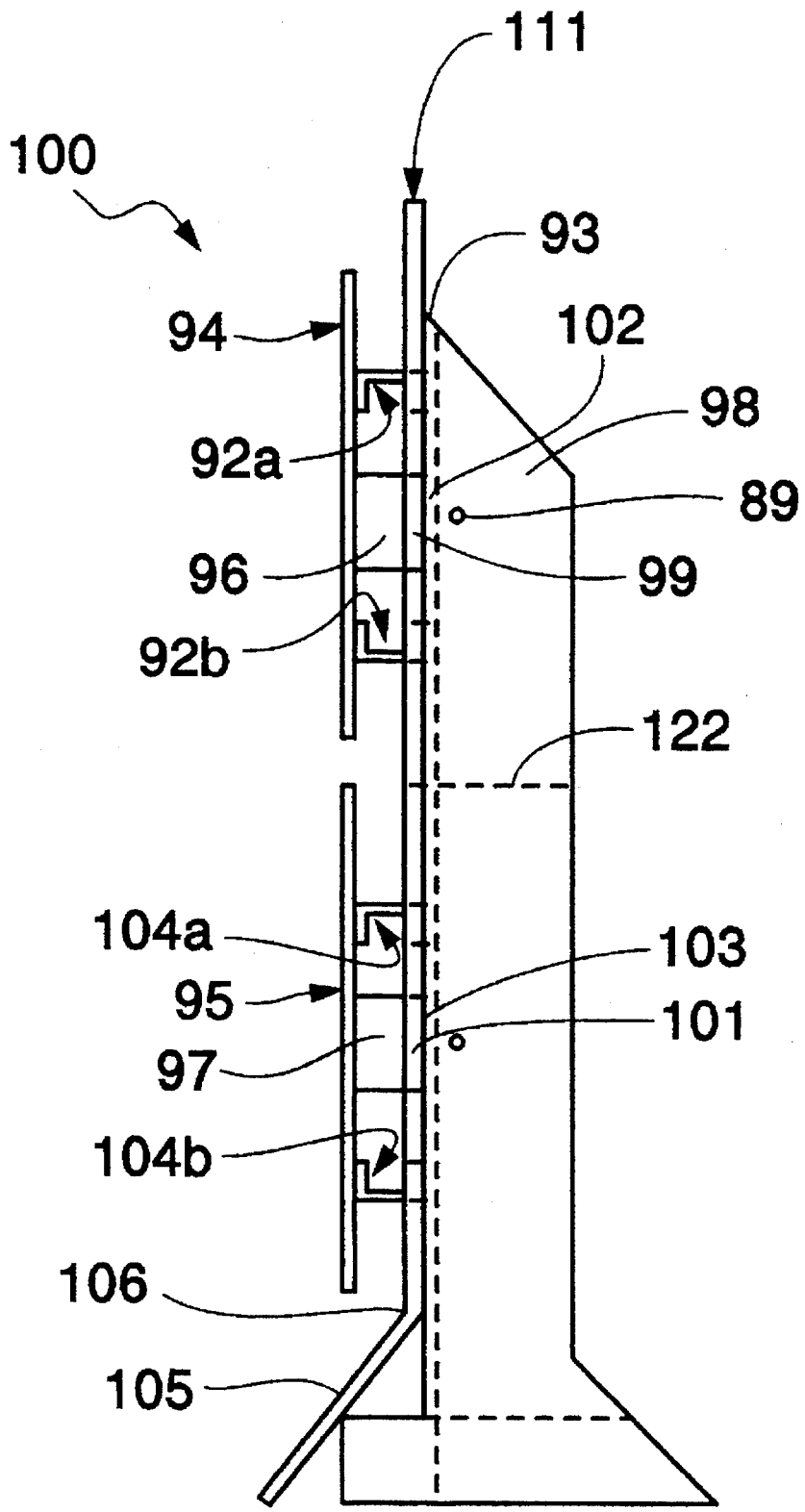
FIG. 12 is a side view of the display stand of FIG. 10.

Referring now to the display apparatus 100 illustrated in FIGS. 10–13, in another embodiment of the invention, an intermediate panel 111 can also be included, for example, to present additional information or images and to provide additional stability to the display apparatus 100. As shown in FIGS. 11 and 12, an intermediate panel 111 may be positioned between and attached to the back panel 93 and the front display panels 94 and 95. Die-cut flaps 92*a* and 92*b* flexibly fasten the front display panel 94 with the intermediate panel 111. Die-cut flaps 104*a* and 104*b* perform similar functions with respect to another front display panel 95. As in the previous embodiments, display apparatus 100 includes an engagement point 89 on the side support panel 98 in order to engage a biasing device. The opposing side support panel includes a similar engagement point (not shown).

The die-cut tongues 96 and 97 of the side support panel 98 correspond to the die-cut holes 99 and 101 in the intermediate panel 111 and the die-cut holes 102 and 103 in the back panel 93. The die-cut holes 99, 101, 102 and 103 in the intermediate panel 111 and the back panel 93, respectively, allow the die-cut tongues 96 and 97 of the side support panel 98 to protrude through and into the back side of the front display panels 94 and 95 as the biasing device urges the side support panel 98 and the opposing side support panel to a position supporting a free-standing display apparatus 100. This embodiment also includes additional die-cut tongues and die-cut holes that correspond to a second side support panel (second side support panel not shown).

The die-cut flaps 92*a*, 92*b*, 104*a* and 104*b* are die-cut from the intermediate panel 111. Alternatively, separate die-cut flaps may be used whereby a first portion of a flap, ending at a first fold line, may be fastened to the intermediate panel 111 and a second portion of a flap, commencing at a second fold line, may be fastened to the front display panels. Or, alternatively a first portion of separate flaps may be fastened to the back panel 93, with the flaps extending through die-cut holes of the intermediate panel 111, with a second portion fastened to the front display panels 94 and 95.

Figure 10:
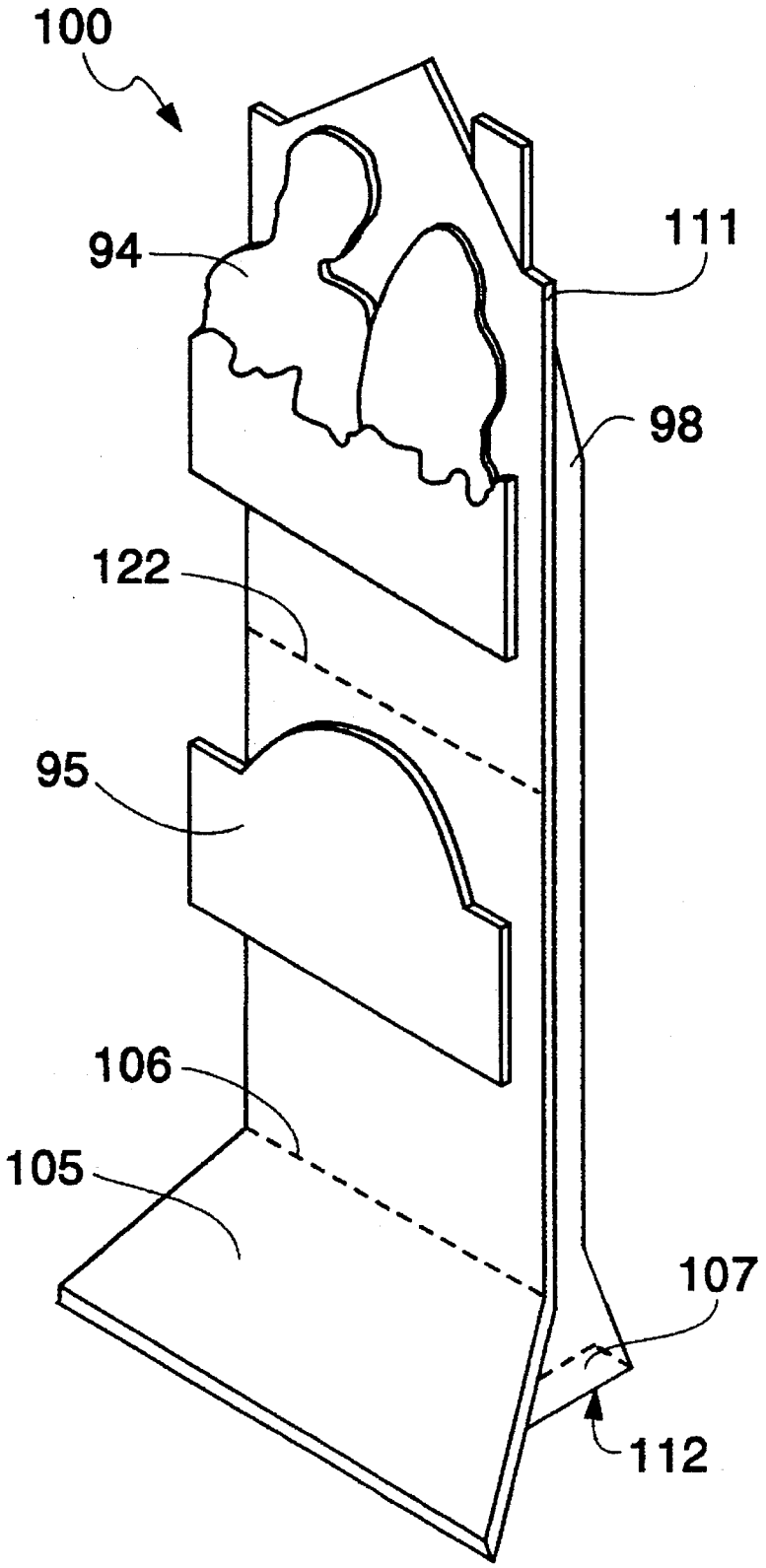
FIG. 10 is a perspective view of another embodiment of the display stand.

As illustrated in FIG. 10, an additional laterally oriented fold line 112 and resulting bottom flap 107 may be provided to a lower portion of the side support panel 98 in order to increase the free-standing stability of the display apparatus 110. The bottom flap 107 is flexibly fastened to a side support panel 98 along a laterally oriented fold line 112. When the display apparatus 110 is erected, the bottom flaps of each side support panel can be folded along the laterally oriented fold lines to a position substantially perpendicular to its corresponding side support panel.

A bottom display panel 105, as shown in FIGS. 10, 11, 12 and 13, flexibly fastened to the lower end of the intermediate panel 111, can be provided to display information and images and to further increase the stability of an upright, free-standing display. Such a bottom display panel can be flexibly fastened to the intermediate panel 111 along a fold line 106 or alternatively, can be a separate piece flexibly fastened to the intermediate panel 111. As shown in FIG. 12, a bottom flap 107 of the side support panel 98 pushes upon the back side of the bottom display panel 105 as the biasing device urges the side support panels to a position supporting a free-standing display apparatus, thereby projecting the bottom display panel 105. Alternatively, the bottom display panel 105 may be flexibly fastened to the lower end of the back panel where an intermediate panel is not provided.

FIG. 13 illustrates the display apparatus 100 of FIG. 10 in a collapsed and folded configuration. Such a compact configuration facilitates shipping and handling. In this configuration, the display apparatus 100 may be collapsed and folded along one laterally oriented fold line, generally denoted by the fold line 122. The fold line 122 laterally extends in substantially parallel planes on the back panel, side support panels and intermediate panel, and is generally positioned between the upper and lower front display panels. In this embodiment, when collapsed and folded, the front display panels 94 and 95 face each other. The intermediate panel 111 has one fold line, generally denoted by the fold line 122. However, in order to accommodate the thickness of a collapsed and folded display apparatus 100, the back panel 93 and the side support panels 98 and 108 can be folded along two, parallel, closely spaced, fold lines, generally parallel and corresponding to the fold line 122.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A self-erecting display apparatus comprising:

(a) a front display panel;

(b) a back panel flexibly fastened to said front display panel;

(c) a first side support panel flexibly fastened to a first side of said back panel;

(d) a first biasing means, associated with at least one of said back panel and first side support panel, for urging said first side support panel to a position supporting a free-standing orientation of said apparatus; and (e) a moving means, associated with said first side support panel, for moving said front display panel outwardly relative to said back panel.

2. An apparatus as claimed in claim 1, wherein said first side support panel includes a means for engaging said first biasing means.

3. An apparatus as claimed in claim 1, wherein said back panel includes a means for engaging said first biasing means.

4. An apparatus as claimed in claim 1, wherein said moving means comprises a first tongue.

5. An apparatus as claimed in claim 4, wherein said first tongue pushes against and projects said front display panel outwardly relative to said back panel as said first biasing means urges said first side support panel to said position supporting said free-standing orientation of said apparatus.

6. An apparatus as claimed in claim 4, wherein said first tongue is die-cut.

7. An apparatus as claimed in claim 1, wherein said front display panel includes information.

8. An apparatus as claimed in claim 7, wherein said information is written and/or pictorial.

9. An apparatus as claimed in claim 1, wherein said first biasing means is selected from the group consisting of springs, rubber bands and elastic bands.

10. An apparatus as claimed in claim 1, further comprising a second side support panel flexibly fastened to said back panel.

11. An apparatus as claimed in claim 10, wherein said second side support panel is flexibly fastened to a second side of said back panel.

12. An apparatus as claimed in claim 10, where at least one of said first and second side support panels includes a means for engaging said biasing means.

13. An apparatus as claimed in claim 10, wherein said moving means is associated with said first and said second side support panels.

14. An apparatus as claimed in claim 13, wherein said moving means includes a first tongue associated with said first side support panel and a first tongue associated with said second side support panel.

15. An apparatus as claimed in claim 14, wherein said first tongue of said first side support panel and said first tongue of said second side support panel push against and project said front display panel upwardly and outwardly relative to said back display panel as said first biasing means urges said first and second side support panels to said positions supporting said free-standing orientation of said apparatus.

16. An apparatus as claimed in claim 15, further comprising an intermediate panel placed in between said front display panel and said back panel, wherein said intermediate panel has first and second holes so that said first tongues of said first and second side support panels may protrude through said first and second holes, respectively, and push on said front display panel.

17. An apparatus as claimed in claim 16, wherein said intermediate panel has third and fourth holes through which said front display panel may be directly flexibly fastened to said back panel.

18. An apparatus as claimed in claim 10, wherein each of said first and said second side support panels have bottom portions, flexibly connected to each of said first and said second side support panels along a latitudinal line, wherein said bottom portions may be folded along said latitudinal line to a position substantially normal to said first and said second side support panels to provide additional support to a free-standing orientation of said display apparatus.

19. An apparatus as claimed in claim 1, further comprising a bottom panel flexibly fastened to said back panel to provide additional support to said free-standing orientation of said apparatus.

20. An apparatus as claimed in claim 19, wherein said moving means includes a second tongue associated with said first side support panel for projecting said bottom panel outwardly relative to said back panel as said first biasing means urges said first side support panel to said position supporting said free-standing orientation of said apparatus.

21. An apparatus as claimed in claim 1, wherein said first side support panel and said back panel each have two sections, said sections flexibly connected along a latitudinal line, wherein said front display panel is substantially centrally situated within said section of said back panel and wherein said sections may be folded onto each other along said latitudinal line to provide for folding of said apparatus.

22. An apparatus as claimed in claim 1, wherein said front display panel moves substantially arcuately relative to said back panel as said moving means moves said front display panel outwardly relative to said back panel.

23. A self-erecting display apparatus comprising:

(a) a front display panel;

(b) a back panel flexibly fastened to said front display panel;

(c) a first side support panel having a first tongue, wherein said first side support panel is flexibly fastened to a side of said back panel; and (d) a first biasing means, associated with at least one of said first side support panel and said back panel, for urging said first side support panel to a position supporting a free-standing orientation of said apparatus and, simultaneously, wherein said first tongue pushes on said front display panel, projecting said front display panel upwardly and outwardly relative to said back panel.

24. An apparatus as claimed in claim 23, further comprising a means for engaging said first biasing means with said back panel.

25. An apparatus as claimed in claim 23, wherein said front display panel includes information.

26. An apparatus as claimed in claim 25, wherein said information is written and/or pictorial.

27. An apparatus as claimed in claim 23, wherein said first tongue is die-cut.

28. A method for erecting a display stand having a first side support panel, a front display panel and a back panel, said first side support panel including a first tongue, said method comprising the steps of:

(a) biasing said first side support panel from a first position substantially planar with said back panel to a second position capable of supporting a free-standing display stand; and (b) simultaneously projecting said front display panel outwardly relative to said back panel as said first tongue pushes against said front display panel when said first side support panel moves from said first position to said second position.

29. A method for erecting a display stand as claimed in claim 28, said display stand further having a second side support panel, said second side support panel having a first tongue, said method further comprising the steps of:

(a) biasing said second side support panel from a first position substantially planar with said back panel to a second position capable of supporting said free-standing display stand; and (b) simultaneously projecting said front display panel outwardly relative to said back panel as said first tongue of said second side support panel pushes against said front display panel and said second side support panel moves from said first position to said second position.

30. A method, as claimed in claim 29, wherein said first and said second side support panels project said front display panel outwardly relative to said back panel simultaneously.

31. A method, as claimed in claim 29, said display stand further having a bottom display panel, said first and said second side support panels further including second tongues, said method further comprising the step of:

simultaneously projecting said bottom panel outwardly relative to said back panel as said second tongues of said first and said second side support panels push against said bottom panel when said first and said second side support panels move from said first positions to said second positions.

32. A self-erecting display apparatus comprising:

(a) a front display panel;

(b) a back panel flexibly fastened to said front display panel;

(c) a first side support panel flexibly fastened to a side of said back panel;

(d) a first biasing means, associated with at least one of said back panel and first side support panel, for urging said first side support panel to a position supporting a free-standing orientation of said apparatus; and (e) a moving means, associated with said first side support panel, for moving said front display panel outwardly relative to said back panel, said moving means including a first tongue, wherein said first tongue pushes against and projects said front display panel outwardly relative to said back panel as said first biasing means urges said first side support panel to said position supporting said free-standing orientation of said apparatus.

33. A self-erecting display apparatus comprising:

(a) a front display panel;

(b) a back panel flexibly fastened to said front display panel;

(c) a first side support panel having a first tongue, wherein said first side support panel is flexibly fastened to a side of said back panel;

(d) a first biasing means, associated with at least one of said first side support panel and said back panel, for urging said first side support panel to a position supporting a free-standing orientation of said apparatus and, simultaneously, wherein said first tongue pushes on said front display panel, projecting said front display panel upwardly and outwardly relative to said back panel; and (e) a means for engaging said first biasing means with said back panel.

* * * * *